US007137509B1

(12) United States Patent
Burns

(10) Patent No.: US 7,137,509 B1
(45) Date of Patent: Nov. 21, 2006

(54) BOWL STACKING SEPARATION DEVICE AND METHOD OF STACKING BOWLS

(76) Inventor: Arthur Dale Burns, 10460 Roosevelt, No. 133, St. Petersburg, FL (US) 33716

( * ) Notice: Subject to any disclaimer, the term of this patent is extended or adjusted under 35 U.S.C. 154(b) by 743 days.

(21) Appl. No.: 09/953,581

(22) Filed: Sep. 12, 2001

(51) Int. Cl.
*B65D 21/00* (2006.01)
*B65D 85/62* (2006.01)

(52) U.S. Cl. ..... 206/516

(58) Field of Classification Search ..... 206/502, 206/505, 515, 516, 519, 521, 585, 593, 821
See application file for complete search history.

(56) References Cited

U.S. PATENT DOCUMENTS 1,369,999 A * 3/1921 Zoia ..... 206/516
4,303,247 A * 12/1981 Fain ..... 473/511
4,902,022 A * 2/1990 Salmon ..... 273/317
5,762,195 A * 6/1998 Stevens ..... 206/499
5,938,499 A * 8/1999 Chen ..... 446/253
6,292,572 B1 * 9/2001 Yoest et al. ..... 381/322

* cited by examiner

*Primary Examiner*—Harry Grosso

(57) ABSTRACT

The present invention provides a bowl stacking separation device and a method of stacking bowls using the bowl stacking separation device. In one embodiment the bowl stacking separation device comprises: (1) a spheroid body; and an (2) elastic surface on the spheroid body with the spheroid body being of a size such that it separates the bottom outer surface of an upper stacked bowl from a bottom inner surface of a lower stacked bowl.

7 Claims, 2 Drawing Sheets

BOWL STACKING SEPARATION DEVICE AND METHOD OF STACKING BOWLS

TECHNICAL FIELD OF THE INVENTION

The present invention is directed, in general, to food service devices and, more specifically, to a bowl stacking separation device used to separate bowls in a stack and a method of stacking bowls.

BACKGROUND OF THE INVENTION

Nearly everyone with even a modicum of cooking experience has struggled to separate two bowls that are stuck. It always seems to happen at the most inconvenient time, such as when the bowl is needed immediately in order to remove something from a hot pan.

There are a number of reasons why stacked bowls tend to stick. Similarly sized bowls frequently become mechanically jammed together when stacked. Bowls having different temperatures frequently stick when stacked because the bowls expand or contract at different rates as the temperatures equalize. Bowls also stick together when the weight of upper bowls in a stack force lower bowls in the stack into even lower bowls. In other cases a vacuum can be created between bowls such that the suction holds the bowls together. Bowls also get stuck when different shapes of bowls are stacked or when bowls made of different materials are stacked. In short, there are a number of reasons why bowls stick or jam together but, regardless of why they stick, it is nearly always maddening when it happens.

People have been known to employ a number of means in order to separate stuck bowls, some of which are extreme. The more moderate of these means range from smartly tapping the bowls on a counter in the hope that vibration will jar them loose to using an instrument, such as a knife or screwdriver, to pry them apart. It is not unusual when frangible bowls are stuck together for one or both of the bowls to be broken in an attempt to separate them. When metal or plastic bowls are stuck, efforts to separate them frequently results in bent edges or scraped surfaces.

A prior art method of preventing stacked bowls from sticking is to place a flat disk or similar object, such as a napkin or towel, in the lower bowl before stacking the upper bowl. Although this method works, it is not the best solution to the problem of bowls sticking together. While the problem of one bowl sticking to another may have been resolved, the new problem of preventing the bowl from sticking to the object inserted between the bowls must now be overcome.

Accordingly, what is needed in the art is a convenient device that can be used to stack bowls so they will not stick to each other or to an object inserted between them to prevent such sticking.

SUMMARY OF THE INVENTION

To address the above-discussed deficiencies of the prior art, the present invention provides a bowl stacking separation device and a method of stacking bowls using the bowl stacking separation device. In one embodiment the bowl stacking separation device comprises: (1) a spheroid body; and (2) an elastic surface on the spheroid body, with the spheroid body being of a size such that it separates the bottom outer surface of an upper stacked bowl from a bottom inner surface of a lower stacked bowl. In one embodiment, the spheroid body is oblate while in another the spheroid body is prolate.

The present invention thus provides a useful device that can be used by kitchens, food preparation services, or any one of a number of different activities where bowls are stacked. This device is particularly useful where bowls have a tendency to stick together because they get jammed together mechanically or where a vacuum is developed between two bowls and suction causes the two bowl surfaces to stick. Besides being a convenience that saves time, the device also serves to reduce breakage when frangible bowls are stacked.

Another embodiment of the invention of the bowl stacking separation device, comprises: (1) a cylindrical body; and (2) an elastic surface on the cylindrical body, with the cylindrical body being of a size such that it separates the bottom outer surface of an upper stacked bowl from the bottom inner surface of a lower stacked bowl. In one embodiment, the cylindrical body has double tapered sides while in another it is a frustum of a cone.

A particularly useful embodiment of the bowl stacking separation device provides for a cork elastic surface. In still another embodiment, the bowl stacking separation device has an elastic surface of rubber. In yet still another embodiment, the elastic surface is plastic.

Although the bowl stacking separation device described herein can be of any size and be within the intended scope of the invention, a particularly useful embodiment provides for the largest radius of the spheroid body or cylindrical body, as the case may be, to be less than one inch. This is a particularly useful size that functions well with a large number of different sizes of bowls.

The foregoing has outlined, rather broadly, preferred and alternative features of the present invention so that those skilled in the art may better understand the detailed description of the invention that follows. Additional features of the invention will be described hereinafter that form the subject of the claims of the invention. Those skilled in the art should appreciate that they can readily use the disclosed conception and specific embodiment as a basis for designing or modifying other structures for carrying out the same purposes of the present invention. Those skilled in the art should also realize that such equivalent constructions do not depart from the spirit and scope of the invention in its broadest form.

BRIEF DESCRIPTION OF THE DRAWINGS

For a more complete understanding of the present invention, reference is now made to the following descriptions taken in conjunction with the accompanying drawings, in which.

DETAILED DESCRIPTION

Figure 1A:
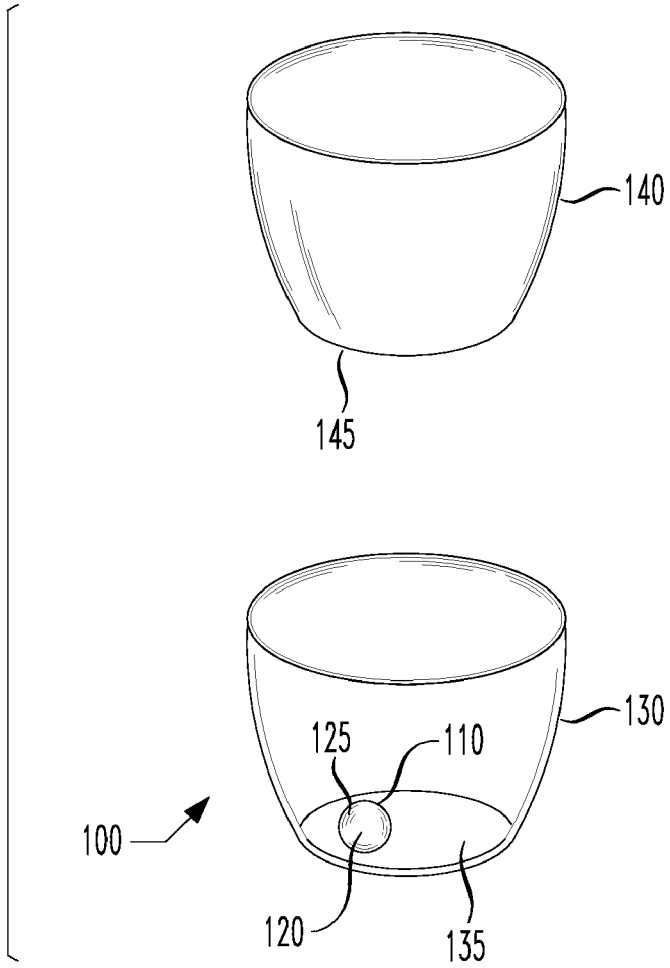
FIG. 1A illustrates an isometric partial sectional view of stacked bowls using an embodiment, constructed in accordance with the present invention, of a bowl stacking separation device that is a spheroid body.

Referring initially to FIG. 1A, illustrated is an isometric partial sectional view of stacked bowls 100 using an embodiment, constructed in accordance with the present invention, of a bowl stacking separation device 110 that is a spheroid body 120. The illustrated stacked bowls 100 show a lower stacked bowl 130 containing a bowl stacking separation device 110 and an upper stacked bowl 140 located over the lower stacked bowl 130. As can be seen, when the upper stacked bowl 140 is placed within the lower stacked bowl 130, the bowl stacking separation device 110 keeps a bottom outer surface 145 of the upper stacked bowl 140 separate from a bottom inner surface 135 of the lower stacked bowl 130.

The illustrated embodiment provides for a spheroid body 120 of a size such that, when an upper stacked bowl 140 is placed within a lower stacked bowl 130, the bowl stacking separation device 110 separates the bottom outer surface 145 of the upper stacked bowl 140 from the bottom inner surface 135 of the lower stacked bowl 130. In one embodiment of the invention, the largest radius of the spheroid body 120 of the bowl stacking separation device 110 is less than one inch.

The invention provides for the spheroid body 120 of the bowl stacking separation device 110 to have an elastic surface 125, which is particularly advantageous when stacked bowls 100 are frangible. The various embodiments of the invention include an elastic surface 125 that is cork, one that is rubber and one that is plastic. Those of ordinary skill in the pertinent art will recognize that other elastic surfaces 125, whether now known or later discovered, can also be used and be within the intended scope of the present invention.

Figure 1B:
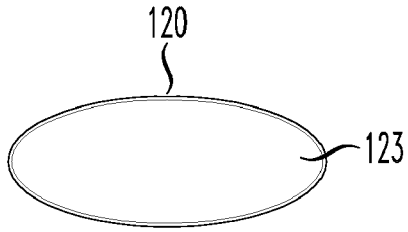
FIG. 1B illustrates a plan view of a spheroid body of a bowl stacking separation device having a prolate shape.

Referring now to FIG. 1B, illustrated are a number of embodiments of a spheroid body 120 bowl stacking separation device 110. Included among the embodiments of a spheroid body 120 that constitute a bowl stacking separation device 110 is a sphere 121, an oblate shape 122 and a prolate shape 123. Those of ordinary skill in the pertinent art will readily understand that other shapes of spheroid bodies 120 are well within the intended scope of the present invention.

Figure 2A:
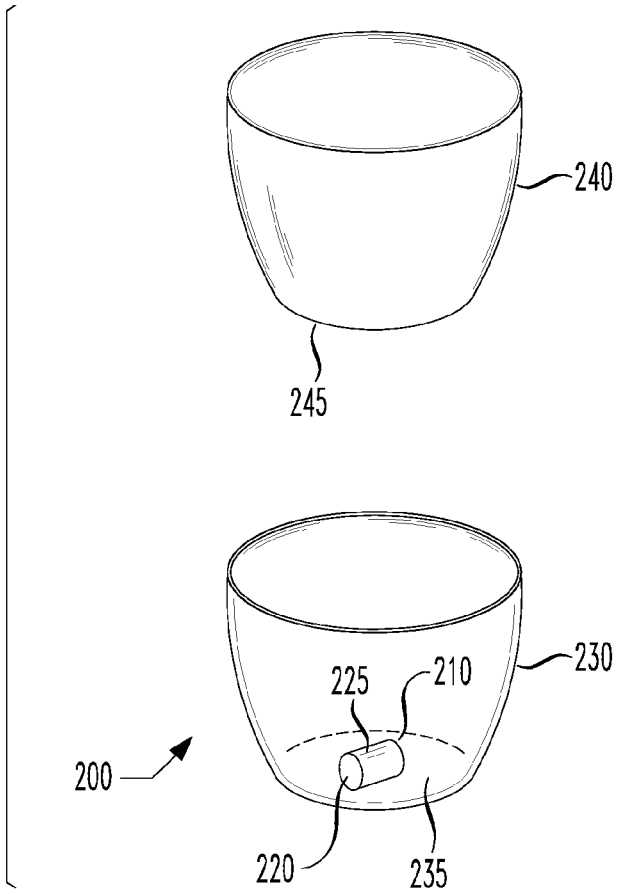
FIG. 2A illustrates an isometric partial sectional view of stacked bowls using an embodiment, constructed in accordance with the present invention, of a bowl stacking separation device that is a cylindrical body.
Figure 2B:
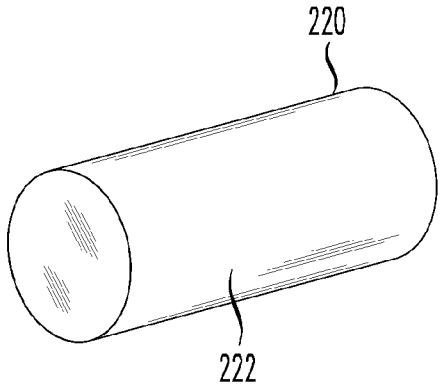
FIG. 2B illustrates an isometric view of a number of cylindrical body embodiments of a bowl stacking separation device

Turning now to FIG. 2A, illustrated is an isometric partial sectional view of stacked bowls 200 using an embodiment, constructed in accordance with the present invention, of a bowl stacking separation device 210 that is a cylindrical body 220. The illustrated stacked bowls 200 show a lower stacked bowl 230 containing a bowl stacking separation device 210 and an upper stacked bowl 240 located over the lower stacked bowl 230. As can be seen, when the upper stacked bowl 240 is placed within the lower stacked bowl 230, the bowl stacking separation device 210 keeps a bottom outer surface 245 of the upper stacked bowl 240 separate from a bottom inner surface 235 of the lower stacked bowl 230.

The illustrated embodiment provides for a cylindrical body 220 of a size such that, when an upper stacked bowl 240 is placed within a lower stacked bowl 230, the bowl stacking separation device 210 separates the bottom outer surface 245 of the upper stacked bowl 240 from the bottom inner surface 235 of the lower stacked bowl 230. In one embodiment of the invention, the largest radius of the cylindrical body 220 of the bowl stacking separation device 210 is less than one inch.

The invention provides for the cylindrical body 220 of the bowl stacking separation device 210 to have an elastic surface 225, which is particularly advantageous when stacked bowls 200 are frangible. The various embodiments of the invention include an elastic surface 225 that is cork, one that is rubber and one that is plastic. Those of ordinary skill in the pertinent art will recognize that other elastic surfaces 225, whether now known or later discovered, can also be used and be within the intended scope of the present invention.

Referring now to FIG. 1B, illustrated are a number of embodiments of a cylindrical body 220 bowl stacking separation device 210. Included among the cylindrical body 220 embodiments of a bowl stacking separation device 210 is a cylinder with double tapered sides 222 and a frustum of a cone 223. Those of ordinary skill in the pertinent art will readily understand that other cylindrical bodies 220 are well within the intended scope of the present invention.

Referring again to FIGS. 1A and 2A, illustrated is a method of stacking bowls. The method starts with placing a bowl stacking separation device 110, 220 within a lower stacked bowl 130, 230. The bowl stacking separation device 110, 120 has an elastic surface 125, 225 and is of a size such that a bottom outer surface 145, 245 of an upper stacked bowl 140, 240 is separated from a bottom inner surface 135, 245 of the lower stacked bowl 130, 240. The method continues with placing the upper stacked bowl 140, 240 within the lower stacked bowl 130, 240.

One embodiment of the method of stacking bowls provides for a bowl stacking separation device 110 that is a spheroid body 120, while another provides for a bowl separation device 210 that is a cylindrical body 220. Embodiments of the method of stacking bowls provide for an elastic surface 125, 225 that is cork, or rubber or plastic. Of course, those of ordinary skill in the pertinent art will readily understand that other elastic surfaces 125, 225 can be used and still be within the intended scope of the present invention.

Although the present invention has been described in detail, those skilled in the art should understand that they can make various changes, substitutions and alterations herein without departing from the spirit and scope of the invention in its broadest form.

What is claimed is:

1. A bowl stacking separation device, comprising:

a stack of at least two bowls; and a spheroid body having an elastic surface inserted within a lower one of said two bowls and located on a bottom inner surface of said lower one of said two bowls so that it is located between an upper one of said at least two bowls and said lower one of said at least two bowls, said spheroid body being of a size such that said spheroid body separates a bottom outer surface of said upper one of said at least two bowls from said bottom inner surface of said lower one of said at least two bowls.

2. The bowl stacking separation device as recited in claim 1 wherein said spheroid body is oblate.

3. The bowl stacking separation device as recited in claim 1 wherein said spheroid body is prolate.

4. The bowl stacking separation device as recited in claim 1 wherein said elastic surface is cork.

5. The bowl stacking separation device as recited in claim 1 wherein said elastic surface is rubber.

6. The bowl stacking separation device as recited in claim 1 wherein said elastic surface is plastic.

7. The bowl stacking separation device as recited in claim 1 wherein the largest radius of said spheroid body is less than one inch.

* * * * *